US007242900B2

(12) United States Patent
Blair et al.

(10) Patent No.: US 7,242,900 B2
(45) Date of Patent: Jul. 10, 2007

(54) OIL-LESS FUSER MEMBER

(75) Inventors: Christopher D. Blair, Webster, NY (US); Ugur Sener, Webster, NY (US); Thomas P. Debies, Webster, NY (US); Joy Longhenry, Webster, NY (US); Alan R. Kuntz, Webster, NY (US)

(73) Assignee: Xerox Corporation, Stamford, CT (US)

( * ) Notice: Subject to any disclaimer, the term of this patent is extended or adjusted under 35 U.S.C. 154(b) by 70 days.

(21) Appl. No.: 11/142,387

(22) Filed: Jun. 2, 2005

(65) Prior Publication Data

US 2006/0275063 A1 Dec. 7, 2006

(51) Int. Cl.
*G03G 15/20* (2006.01)

(52) U.S. Cl. ..... 399/333; 430/97

(58) Field of Classification Search ..... 399/333, 399/320, 328, 330, 335; 430/97–99
See application file for complete search history.

(56) References Cited

U.S. PATENT DOCUMENTS 4,029,827 A 6/1977 Imperial et al.
4,101,686 A 7/1978 Strella et al.
4,185,140 A 1/1980 Strella et al.
4,257,699 A 3/1981 Lentz
4,264,181 A 4/1981 Lentz et al.
4,272,179 A 6/1981 Seanor
4,515,884 A 5/1985 Field et al.
4,968,766 A 11/1990 Kendziorski
5,017,432 A 5/1991 Eddy et al.
5,061,965 A 10/1991 Ferguson et al.
5,166,031 A 11/1992 Badesha et al.
5,281,506 A 1/1994 Badesha et al.
5,366,772 A 11/1994 Badesha et al.
5,370,931 A 12/1994 Fratangelo et al.
5,401,570 A 3/1995 Heeks et al.
5,409,557 A 4/1995 Mammino et al.
5,463,009 A 10/1995 Okada et al.
5,487,707 A 1/1996 Sharf et al.
5,512,409 A 4/1996 Henry et al.
5,514,436 A 5/1996 Schlueter, Jr. et al.
5,516,361 A 5/1996 Chow et al.
5,568,239 A 10/1996 Furukawa et al.
5,624,780 A 4/1997 Nishimori et al.
5,627,000 A 5/1997 Yamazaki et al.
5,636,012 A 6/1997 Uneme et al.
5,641,603 A 6/1997 Yamazaki et al.
5,698,320 A 12/1997 Ebisu et al.
5,716,747 A 2/1998 Uneme et al.
5,757,214 A 5/1998 Stoddard et al.
5,886,090 A * 3/1999 Yamana et al.

(Continued)

OTHER PUBLICATIONS

U.S. Appl. No. 10/743,097, filed Dec. 23, 2003, Vandewinckel et al.

(Continued)

*Primary Examiner*—David M. Gray
*Assistant Examiner*—Laura K Roth
(74) *Attorney, Agent, or Firm*—Oliff & Berridge, PLC

(57) ABSTRACT

A fuser member includes a substrate and an outer layer comprising a polymeric material, wherein the polymeric material is post-halogenated to provide a post-halogenated polymeric material. The fuser member is advantageously used without a release oil applied to the outer layer.

20 Claims, 1 Drawing Sheet

U.S. PATENT DOCUMENTS

| | | | | |
|---|---|---|---|---|
| 5,991,590 | A | 11/1999 | Chang et al. | |
| 6,045,961 | A * | 4/2000 | Heeks et al. | |
| 6,099,673 | A | 8/2000 | Van Bennekom | |
| 6,197,989 | B1 | 3/2001 | Furukawa et al. | |
| 6,253,055 | B1 | 6/2001 | Badesha et al. | |
| 6,377,774 | B1 | 4/2002 | Maul et al. | |
| 6,408,753 | B1 | 6/2002 | Finn et al. | |
| 6,954,607 | B2 * | 10/2005 | Kellie et al. | 399/328 |
| 2004/0003828 | A1 * | 1/2004 | Jackson | |
| 2004/0185271 | A1 | 9/2004 | Kaplan et al. | |
| 2005/0048294 | A1 | 3/2005 | Kaplan et al. | |
| 2006/0083878 | A1 * | 4/2006 | Bauman | |

OTHER PUBLICATIONS

U.S. Appl. No. 10/743,096, filed Dec. 23, 2003, Vandewinckel et al.
U.S. Appl. No. 10/876,557, filed Jun. 28, 2004, Moffat et al.
U.S. Appl. No. 10/876,575, filed Jun. 28, 2004, Moffat et al.
U.S. Appl. No. 10/876,565, filed Jun. 28, 2004, Moffat et al.
U.S. Appl. No. 11/089,149, filed Mar. 25, 2005, Sacripante et al.

* cited by examiner

OIL-LESS FUSER MEMBER

BACKGROUND

This disclosure relates generally to fuser members useful in electrophotographic reproducing apparatuses, including digital, image on image, and contact electrostatic printing apparatuses. The present fuser members can be used as fuser members, pressure members, transfuse or transfix members, and the like. In an embodiment, the fuser members comprise an outer layer comprising a post-halogenated polymeric material. In embodiments, the polymeric material can be either non-halogenated or halogenated before the post-halogenation treatment. In embodiments, the fuser member is oil-less, i.e., it is used without an applied release agent.

In a typical electrostatographic reproducing apparatus, a light image of an original to be copied is recorded in the form of an electrostatic latent image upon a photosensitive member, and the latent image is subsequently rendered visible by the application of electroscopic thermoplastic resin particles and pigment particles, or toner. The visible toner image is then in a loose powdered form and can be easily disturbed or destroyed. The toner image is usually fixed or fused upon a support, which may be the photosensitive member itself, or other support sheet such as plain paper.

The use of thermal energy for fixing toner images onto a support member is well known. To fuse electroscopic toner material onto a support surface permanently by heat, it is usually necessary to elevate the temperature of the toner material to a point at which the constituents of the toner material coalesce and become tacky. This heating causes the toner to flow to some extent into the fibers or pores of the support member. Thereafter, as the toner material cools, solidification of the toner material causes the toner material to be firmly bonded to the support.

Typically, the thermoplastic resin particles are fused to the substrate by heating to a temperature of between about 90° C. to about 200° C. or higher depending upon the softening range of the particular resin used in the toner. It may be undesirable; however, to increase the temperature of the substrate substantially higher than about 250° C. because of the tendency of the substrate to discolor or convert into fire at such elevated temperatures, particularly when the substrate is paper.

Several approaches to thermal fusing of electroscopic toner images have been described. These methods include providing the application of heat and pressure substantially concurrently by various means, a roll pair maintained in pressure contact, a belt member in pressure contact with a roll, a belt member in pressure contact with a heater, and the like. Heat may be applied by heating one or both of the rolls, plate members, or belt members. The fusing of the toner particles takes place when the proper combinations of heat, pressure and contact time are provided. The balancing of these parameters to bring about the fusing of the toner particles is well known in the art, and can be adjusted to suit particular machines or process conditions.

During operation of a fusing system in which heat is applied to cause thermal fusing of the toner particles onto a support, both the toner image and the support are passed through a nip formed between the roll pair, or plate or belt members. The concurrent transfer of heat and the application of pressure in the nip affect the fusing of the toner image onto the support. It is important in the fusing process that no offset of the toner particles from the support to the fuser member takes place during normal operations. Toner particles offset onto the fuser member may subsequently transfer to other parts of the machine or onto the support in subsequent copying cycles, thus increasing the background or interfering with the material being copied there. The referred to "hot offset" occurs when the temperature of the toner is increased to a point where the toner particles liquefy and a splitting of the molten toner takes place during the fusing operation with a portion remaining on the fuser member. The hot offset temperature or degradation of the hot offset temperature is a measure of the release property of the fuser roll, and accordingly it is desired to provide a fusing surface, which has a low surface energy to provide the necessary release. To ensure and maintain good release properties of the fuser roll, it has become customary to apply release agents to the fuser roll during the fusing operation. Typically, these materials are applied as thin films of, for example, nonfunctional silicone oils or mercapto- or amino-functional silicone oils, to prevent toner offset.

U.S. Pat. No. 4,257,699 to Lentz, the subject matter of which is hereby incorporated by reference in its entirety, discloses a fuser member comprising at least one outer layer of an elastomer containing a metal-containing filler and use of a polymeric release agent.

U.S. Pat. No. 4,264,181 to Lentz et al., the subject matter of which is hereby incorporated by reference in its entirety, discloses a fuser member having an elastomer surface layer containing metal-containing filler therein and use of a polymeric release agent.

U.S. Pat. No. 4,272,179 to Seanor, the subject matter of which is hereby incorporated by reference in its entirety, discloses a fuser member having an elastomer surface with a metal-containing filler therein and use of a mercapto-functional polyorganosiloxane release agent.

U.S. Pat. No. 5,401,570 to Heeks et al., the subject matter of which is hereby incorporated by reference in its entirety, discloses a fuser member comprised of a substrate and thereover a silicone rubber surface layer containing a filler component, wherein the filler component is reacted with a silicone hydride release oil.

U.S. Pat. No. 4,515,884 to Field et al., the subject matter of which is hereby incorporated by reference in its entirety, discloses a fuser member having a silicone elastomer-fusing surface, which is coated with a toner release agent, which includes an unblended polydimethyl siloxane.

U.S. Pat. No. 5,512,409 to Henry et al. teaches a method of fusing thermoplastic resin toner images to a substrate using amino functional silicone oil over a hydrofluoroelastomer fuser member.

U.S. Pat. No. 5,516,361 to Chow et al. teaches a fusing member having a thermally stable FKM hydrofluoroelastomer surface and having a polyorgano T-type amino functional oil release agent. The oil has predominantly monoamino functionality per active molecule to interact with the hydrofluoroelastomer surface.

U.S. Pat. No. 6,253,055 to Badesha et al. discloses a fuser member coated with a hydride release oil.

U.S. Pat. No. 5,991,590 to Chang et al. discloses a fuser member having a low surface energy release agent outermost layer.

U.S. Pat. No. 6,377,774 B1 to Maul et al. discloses an oil web system.

U.S. Pat. No. 6,197,989 B1 to Furukawa et al. discloses a fluorine-containing organic silicone compound represented by a formula.

U.S. Pat. No. 5,757,214 to Kato et al. discloses a method for forming color images by applying a compound which contains a fluorine atoms and/or silicon atom to the surface of electrophotographic light-sensitive elements.

U.S. Pat. No. 5,716,747 to Uneme et al. discloses a fluororesin coated fixing device with a coating of a fluorine containing silicone oil.

U.S. Pat. No. 5,698,320 to Ebisu et al. discloses a fixing device coated with a fluororesin, and having a fluorosilicone polymer release agent.

U.S. Pat. No. 5,641,603 to Yamazaki et al. discloses a fixing method using a silicone oil coated on the surface of a heat member.

U.S. Pat. No. 5,636,012 to Uneme et al. discloses a fixing device having a fluororesin layer surface, and using a fluorine-containing silicone oil as a repellant oil.

U.S. Pat. No. 5,627,000 to Yamazaki et al. discloses a fixing method having a silicone oil coated on the surface of the heat member, wherein the silicone oil is a fluorine-containing silicone oil and has a specific formula.

U.S. Pat. No. 5,624,780 to Nishimori et al. discloses a fixing member having a fluorine-containing silicone oil coated thereon, wherein the silicone oil has a specific formula.

U.S. Pat. No. 5,568,239 to Furukawa et al. discloses a stainproofing oil for heat fixing, wherein the fluorine-containing oil has a specific formula.

U.S. Pat. No. 5,463,009 to Okada et al. discloses a fluorine-modified silicone compound having a specific formula, wherein the compound can be used for oil-repellancy in cosmetics.

U.S. Pat. No. 4,968,766 to Kendziorski discloses a fluorosilicone polymer for coating compositions for longer bath life.

The use of polymeric release agents having functional groups, which interact with a fuser member to form a thermally stable, renewable self-cleaning layer having good release properties for electroscopic thermoplastic resin toners, is described in U.S. Pat. Nos. 4,029,827; 4,101,686; and. 4,185,140, the disclosures each of which are incorporated by reference herein in their entirety; Disclosed in U.S. Pat. No. 4,029,827 is the use of polyorganosiloxanes having mercapto functionality as release agents. U.S. Pat. Nos. 4,101,686 and 4,185,140 are directed to polymeric release agents having functional groups such as carboxy, hydroxy, epoxy, amino, isocyanate, thioether and mercapto groups as release fluids. U.S. Pat. No. 5,716,747 discloses the use of fluorine-containing silicone oils for use on fixing rollers with outermost layers of ethylene tetrafluoride perfluoro alkoxyethylene copolymer, polytetrafluoroethylene and polyfluoroethylenepropylene copolymer. U.S. Pat. No. 5,698,320 discloses the use of fluorosilicone polymers for use on fixing rollers with outermost layers of perfluoroalkoxy and tetrafluoroethylene resins.

Examples of release agents for fuser members are nonfunctional silicone release oils, mercapto-functional silicone release oils, and amino-functional silicone release oils. However, depending on the type of outer layer of the fuser member chosen, there may be several drawbacks to using nonfunctional, mercapto-functional, or amino-functional silicone oils as release agents. For example, for silicone rubber outer layers, the silicone release agents provide adequate wetting of the silicone rubber surface. However, the nonfunctional and functional silicone release agents can swell the silicone rubber coating. Swelling shortens roll life because it weakens the silicone, resulting in rapid mechanical wear. High viscosity (13,000 cS) nonfunctional fluids are currently used with silicone rolls, because these fluids do not swell the rolls as much as lower viscosity (100-350 cS) oils. However, high viscosity oils present fluid management problems and do not wet the fuser as efficiently.

On the other hand, fluoroelastomers used as an outer coating for fuser members are more durable and abrasion resistant than silicone rubber fuser members. Also, fluoroelastomer outer coatings do not swell when contacted by nonfunctional or functional silicone fluids. Therefore, fluoroelastomers are the current desired outer fuser member coating.

With regard to known fusing oils, amino-functional oil has been used with fluoroelastomer fuser member outer layers. However, amino oil does not diffuse into paper products, but instead, reacts with the cellulose in the paper and therefore remains on the surface of the paper. It is believed that hydrogen bonding occurs between the amine groups in the amino oil and the cellulose hydroxy groups of the paper. Alternatively, the amine groups may hydrolyze the cellulose rings in the paper. The amino oil on the surface of the copied paper prevents the binding of glues and adhesives, including the attachable notes such as adhesive of 3-M Post-it® notes, to the surface of the copied paper. In addition, the amino silicone oil present on the surface of a copied paper prevents ink adhesion to the surface of the paper. This problem results in the poor fix of inks such as bank check endorser inks, and other similar inks.

Yet another drawback to use of amino silicone and silicone fuser release agents is that the release agents do not always react as well with conductive fillers which may be present in the fuser roll surface. It is desirable for the release agent to react with the fillers present on the outer surface of the fuser member in order to lower the surface area of the fillers. The result is that the conductive filler may be highly exposed on the surface of the fuser member, thereby resulting in increased surface energy of the exposed conductive filler, which will cause toner to adhere to it. An increased surface energy, in turn, results in decrease in release, increase in toner offset, and shorter fusing release life.

Another drawback of the use of amino silicone release agents is the high reactivity of amino groups, which facilitates gelation, of the polydimethylsiloxane release fluid, and which leads to reaction of the fluid with constituents in the toner. Both of these chemical reactions can cause attachment of toner to the fuser roll surface, and shorten fusing release life.

Therefore, for fluoroelastomeric and other fuser member outer layers, there exists a specific need for improved designs, which would allow the use of fuser members without a release agent, i.e., oil-less fuser members. However, in order for such oil-less fuser members to be functional, the design requires both a fuser member that can properly operate with a release agent, and a toner composition that can properly function with the fuser member.

Various suitable toner compositions have been developed. See, for example, U.S. patent applications Ser. Nos. 10/743,097 and 10/743,096, both filed Dec. 23, 2003; Ser. Nos. 10/876,557, 10/876,575, and 10/876,565, all filed Jun. 28, 2004; and Ser. No. 11/089,149, filed Mar. 25, 2005, the entire disclosures of which are incorporated herein by reference.

SUMMARY

The present disclosure addresses these and other needs, by providing an oil-less fuser member for use in developing electrophotographic images.

Embodiments of the present disclosure include: a fuser member comprising a substrate and an outer polymer layer, wherein the outer polymer layer is post-halogenated to provide a release layer that does not require an oil or release agent.

More particularly, in embodiments, the present disclosure provides a fuser member comprising:

a substrate; and an outer layer comprising a polymeric material;

wherein said polymeric material is post-halogenated to provide a post-halogenated polymeric material.

In another embodiment, there is provided a method of making a fuser member, comprising:

applying an outer layer comprising a polymeric material over a substrate; and subjecting said polymeric material of said outer layer to a post-halogenation treatment to provide a post-halogenated polymeric material.

In a still further embodiment, there is provided a an image forming apparatus for forming images on a recording medium comprising:

a charge-retentive surface to receive an electrostatic latent image thereon;

a development component to apply a developer material to the charge-retentive surface to develop the electrostatic latent image to form a developed image on the charge retentive surface;

a transfer component to transfer the developed image from the charge retentive surface to a copy substrate; and a fuser member component to fuse the transferred developed image to the copy substrate, wherein the fuser member comprises:

a substrate; and an outer layer comprising a polymeric material;

wherein said polymeric material is post-halogenated to provide a post-halogenated polymeric material.

BRIEF DESCRIPTION OF THE DRAWINGS

These and other advantages and features of this disclosure will be apparent from the following, especially when considered with the accompanying drawings, in which.

DETAILED DESCRIPTION OF PREFERRED EMBODIMENTS

The present disclosure relates to fuser members having a post-halogenated outer layer. The fuser member has an outer layer, such as a fluoroelastomer layer, that is subject to post-halogenated treatment to provide a further halogenated surface layer. This post-halogenated layer allows the fuser member to be used without an applied release agent. The post-halogenated layer allows sufficient release of the toner composition from the fuser member, while not providing a release agent that would interact with copy substrates such as paper, and thus does not interfere with adhesives and POST-IT® notes (by 3M) and-like tabs, adhering to the copy substrate such as paper. The post-halogenated outer layer, in embodiments, enables increase in life of the fuser member, and further provides little or no interaction with toner constituents, and does not promote fuser fluid gelation, thus increasing fuser member life. Also, metal oxide or other anchoring sites on the fuser member surface are not required by use of the post-halogenated layer, hereby reducing safety concerns and lowering fuser member fabrication costs. The elimination of metal oxides is desired, since the oxides catalyze an increased reactivity with fluoroelastomer surfaces toward charge control agents in toner, and thereby shorten roll life. In addition, the use of the post-halogenated layer, in embodiments, reduces or eliminates fuser contamination.

Figure 1:
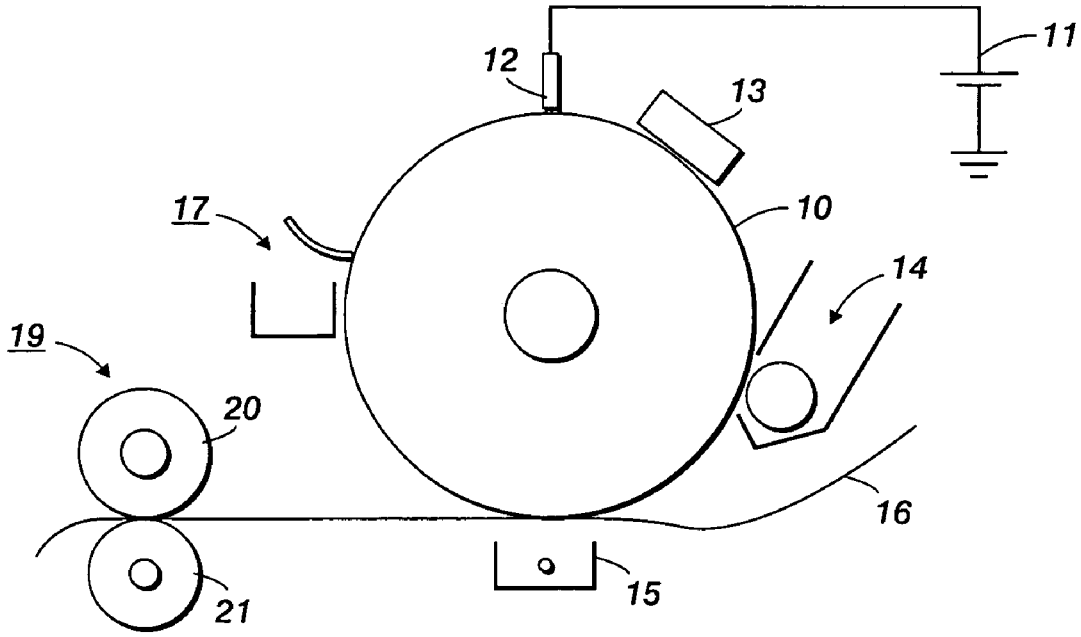
FIG. 1 is a schematic illustration of an image apparatus in accordance with the present disclosure.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. Specifically, photoreceptor 10 is charged on its surface by means of a charger 12 to which a voltage has been supplied from power supply 11. The photoreceptor is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process. A dry developer mixture usually comprises carrier granules having toner particles adhering triboelectrically thereto. Toner particles are attracted from the carrier granules to the latent image forming a toner powder image thereon. Alternatively, a liquid developer material may be employed, which includes a liquid carrier having toner particles dispersed therein. The liquid developer material is advanced into contact with the electrostatic latent image and the toner particles are deposited thereon in image configuration.

After the toner particles have been deposited on the photoconductive surface, in image configuration, they are transferred to a copy sheet 16 by transfer means 15, which can be pressure transfer or electrostatic transfer. Alternatively, the developed image can be transferred to an intermediate transfer member, or bias transfer member, and subsequently transferred to a copy sheet. Examples of copy substrates include paper, transparency material such as polyester, polycarbonate, or the like, cloth, wood, or any other desired material upon which the finished image will be situated.

After the transfer of the developed image is completed, copy sheet 16 advances to fusing station 19, depicted in FIG. 1 as fuser roll 20 and pressure roll 21 (although any other fusing components such as fuser belt in contact with a pressure roll, fuser roll in contact with pressure belt, and the like, are suitable for use with the present apparatus), wherein the developed image is fused to copy sheet 16 by passing copy sheet 16 between the fusing and pressure members, thereby forming a permanent image. Alternatively, transfer and fusing can be effected by a transfix application.

Photoreceptor 10, subsequent to transfer, advances to cleaning station 17, wherein any toner left on photoreceptor 10 is cleaned therefrom by use of a blade (as shown in FIG. 1), brush, or other cleaning apparatus.

Figure 2:
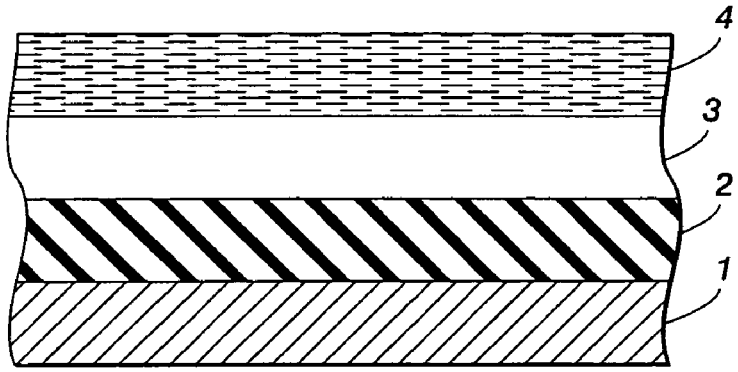
FIG. 2 is an enlarged, side view of an embodiment of a fuser member, showing a fuser member with a substrate, intermediate layer, and post-halogenated outer layer.

FIG. 2 is an enlarged schematic view of an embodiment of a fuser member, demonstrating the various possible layers. As shown in FIG. 2, substrate 1 has intermediate layer 2 thereon. Intermediate layer 2 can be, for example, a rubber such as silicone rubber or other suitable rubber material. On intermediate layer 2 is positioned outer layer 3 comprising a polymer as described below. The outer polymer layer 3 is post-halogenated, which results in a post-halogenated layer 4 to form. This post-halogenated layer is shown as a distinct layer 4 in FIG. 2, because the post-halogenation treatment alters the surface of the outer layer 3 by introducing additional halogen species. Thus, although the post-halogenated outer layer 3,4 is shown as distinct layers in FIG. 2, the distinction may not be as obvious in the product, and the proportions between the layers are not accurate in the figure.

As used herein, the terms "halogenated polymer" or "flouropolymer" refers to any polymer, at least a surface of which is halogenated by any suitable method. Halogenated polymers include "halocarbon polymers" where the polymer is initially formed from halogen-containing monomeric units, "post-halogenated polymers", and polymeric materials produced by combinations of the above methods. "Post-halogenated polymers" are any polymers, at least a surface of which is halogenated, such as fluorinated, subsequent to formation of the polymer material. Thus, for example, the term refers to polymeric materials wherein at least a surface of the polymer material is subsequently halogenated by suitable treatment methods to introduce halogen species into at least the surface layer of the polymeric material. With regard to any of the above polymers, any of the halogens may be used, including fluorine, chlorine, bromine, iodine, and astatine, although fluorine is preferred. For example, a flouropolymer (a halogenated polymer" can be subjected to a post-halogenation treatment, which has the effect of further halogenating the already-halogenated polymer to produce a post-halogenated polymer.

In other words, a distinction can be made between halogenated polymers, such as polymers made from halogenated materials, and post-halogenated polymers. In the case of polymers made from halogenated materials, the halogen species are generally uniformly distributed throughout the polymer material, including inside the bulk material. In contrast, due to the nature of the post-halogenation treatment, the halogen species in post-halogenated materials are more highly distributed on the outer surface of the material, providing a halogenated barrier-type layer on the surface. In the case of a halogenated polymer (such as PTFE) that is subjected to post-halogenation treatment, the result is a polymeric material with the halogen species distributed throughout the bulk material (due to use of the halogenated polymer) but with a higher halogen species concentration on the outer surface of the material, providing a halogenated barrier-type layer on the surface, resulting from the post-halogenation treatment. It is this barrier-type layer that is believed to provide the improved release properties to the fuser members of the disclosure, allowing them to be used without an applied release oil.

The term "fuser member" as used herein refers to fuser members including fusing rolls, belts, films, sheets, and the like; donor members, including donor rolls, belts, films, sheets, and the like; and pressure members, including pressure rolls, belts, films, sheets, and the like; and other members useful in the fusing system of an electrostatographic or xerographic, including digital, machine. The fuser member of the present disclosure can be employed in a wide variety of machines, and is not specifically limited in its application to the particular embodiment depicted herein.

The outer layer of the fuser member, which is subjected to post-halogenation treatment, can be formed of any suitable polymeric material, including, but not limited to, polyolefins, fluorinated hydrocarbons (fluorocarbons), and engineered resins. The outer layer can comprise homopolymers, copolymers, higher order polymers, or mixtures thereof, and can comprise one species of polymeric material or mixtures of multiple species of polymeric material. Preferably, the outer layer is formed of a fluoroelastomer.

Specifically, suitable fluoroelastomers are those described in detail in U.S. Pat. Nos. 5,166,031, 5,281,506, 5,366,772, 5,370,931, 4,257,699, 5,017,432 and 5,061,965, the disclosures each of which are incorporated by reference herein in their entirety. As described therein, these elastomers are from the class of 1) copolymers of vinylidenefluoride and hexafluoropropylene; 2) terpolymers of vinylidenefluoride, hexafluoropropylene and tetrafluoroethylene; and 3) tetrapolymers of vinylidenefluoride, hexafluoropropylene, tetrafluoroethylene and cure site monomer, are known commercially under various designations as VITON A®, VITON B®, VITON E®, VITON E 60C®, VITON E430®, VITON 910®, VITON GH®; VITON GF®; and VITON ETP®. The VITON® designation is a Trademark of E.I. DuPont de Nemours, Inc. The cure site monomer can be 4-bromoperfluorobutene-1,1,1-dihydro-4-bromoperfluorobutene-1,3-bromoperfluoropropene-1,1,1-dihydro-3-bromoperfluoropropene-1, or any other suitable, known cure site monomer commercially available from DuPont. Other commercially available fluoropolymers include FLUOREL 2170®, FLUOREL 2174®, FLUOREL 2176®, FLUOREL 2177® and FLUOREL LVS 76®, FLUOREL® being a Trademark of 3M Company. Additional commercially available materials include AFLAS™ a poly(propylene-tetrafluoroethylene) and FLUOREL II® (LII900) a poly(propylene-tetrafluoroethylenevinylidenefluoride) both also available from 3M Company, as well as the Tecnoflons identified as FOR-60KIRO, FOR-LHF®, NM® FOR-THF®, FOR-TFS®, TH®, and TN505®, available from Montedison Specialty Chemical Company.

Examples of fluoroelastomers useful for the surfaces of fuser members include fluoroelastomers, such as fluoroelastomers of vinylidenefluoride-based fluoroelastomers, hexafluoropropylene and tetrafluoroethylene as comonomers. There are also copolymers of one of vinylidenefluoride, hexafluoropropylene and tetrafluoroethylene. Examples of three known fluoroelastomers are (1) a class of copolymers of two of vinylidenefluoride, hexafluoropropylene and tetrafluoroethylene, such as those known commercially as VITON A® (2) a class of terpolymers of vinylidenefluoride, hexafluoropropylene and tetrafluoroethylene known commercially as VITON B® and (3) a class of tetrapolymers of vinylidenefluoride, hexafluoropropylene, tetrafluoroethylene and cure site monomer known commercially as VITON GH® or VITON GF®.

The fluoroelastomers VITON GH® and VITON GF® have relatively low amounts of vinylidenefluoride. The VITON GF® and Viton GH® have about 35 weight percent of vinylidenefluoride, about 34 weight percent of hexafluoropropylene and about 29 weight percent of tetrafluoroethylene with about 2 weight percent cure site monomer.

The amount of fluoroelastomer compound in solution in the outer layer solutions, in weight percent total solids, is from about 10 to about 25 percent, or from about 16 to about 22 percent by weight of total solids. Total solids as used herein include the amount of fluoroelastomer, dehydrofluorinating agent and optional adjuvants and fillers, including metal oxide fillers.

In addition to the fluoroelastomer, the outer layer may comprise a fluoropolymer or other fluoroelastomer blended with the above fluoroelastomer. Examples of suitable polymer blends include the above fluoroelastomer, blended with a fluoropolymer selected from the group consisting of polytetrafluoroethylene and perfluoroalkoxy. The fluoroelastomer can also be blended with non-fluorinated ethylene or non-fluorinated propylene.

An inorganic particulate filler may be used in connection with the fluoroelastomer outer layer. Such inorganic fillers have traditionally been used in order to provide anchoring sites for the functional groups of an applied silicone fuser agent. However, a filler is not necessary for use with the present fuser member, having a post-halogenated surface layer not requiring a separate release agent. In fact, dispensing with a metal oxide increases fuser life and decreases fabrication costs. Examples of suitable fillers include a metal-containing filler, such as a metal, metal alloy, metal oxide, metal salt or other metal compound. The general classes of metals which are applicable to the present invention include those metals of Groups 1b, 2a, 2b, 3a, 3b, 4a, 4b, 5a, 5b, 6b, 7b, 8 and the rare earth elements of the Periodic Table. The filler can be an oxide of aluminum, copper, tin, zinc, lead, iron, platinum, gold, silver, antimony, bismuth, zinc, iridium, ruthenium, tungsten, manganese, cadmium, mercury, vanadium, chromium, magnesium, nickel and alloys thereof. Other specific examples include inorganic particulate fillers are aluminum oxide and cupric oxide. Other examples include reinforcing and non-reinforcing calcined alumina and tabular alumina respectively.

Other adjuvants and fillers can be incorporated in the polymer of the outer surface layer, provided that they do not affect the integrity of the polymer material. Such fillers normally encountered in the compounding of elastomers include coloring agents, reinforcing fillers, processing aids, accelerators, and the like. Oxides, such as magnesium oxide, and hydroxides, such as calcium hydroxide, are suitable for use in curing many fluoroelastomers. Proton acids, such as stearic acid, are suitable additives in EPDM and BR polymer formulations to improve release by improving bonding of amino oils to the elastomer composition. Other metal oxides, such as cupric oxide, lead oxide and/or zinc oxide, can also be used to improve release. Metal oxides, such as copper oxide, aluminum oxide, magnesium oxide, tin oxide, titanium oxide, iron oxide, zinc oxide, manganese oxide, molybdenum oxide, and the like, carbon black, graphite, metal fibers and metal powder particles such as silver, nickel, aluminum, and the like, as well as mixtures thereof, can promote thermal conductivity. The addition of silicone particles to a fluoropolymer outer fusing layer can increase release of toner from the fuser member during and following the fusing process. Processability of a fluoropolymer outer fusing layer can be increased by increasing absorption of silicone oils, in particular by adding fillers such as fumed silica or clays such as organo-montmorillonites. Also suitable are reinforcing calcined alumina and non-reinforcing tabular alumina.

The thickness of the outer fluoroelastomer surface layer of the fuser member herein is from about 10 to about 250 micrometers, or from about 15 to about 100 micrometers.

After the outer surface layer is applied to the fuser member, it is subjected to a post-halogenation treatment. The post-halogenation treatment may provide halogenation of the polymer material substantially only on a surface of the polymer material. That is, the halogen atoms (or additional halogen atoms, in the case of an already halogenated material) are deposited into the polymer matrix primarily at the surface, leaving at least a portion (i.e., an interior layer) of the thickness of the polymer matrix substantially unhalogenated. Thus, the treatment halogenates the polymer matrix such that a majority of the halogen atoms are located on the exposed surface of the polymer material, and fewer halogen atoms are present as the depth into the polymer matrix increases.

During the post-halogenation process, at least the outer surface of the fuser member is exposed to a fluorine-containing source, such as liquid, gas, or plasma. Briefly, during fluorination, the fluorine attacks accessible (surface) polymer molecules and replaces protons attached to the polymer backbone. Post-halogenation can be accomplished by any conventional means using, for example, a suitable halogen source, such as a fluorine-containing gas or a chlorine-containing gas.

Although not limited to any particular method, the post-halogenation treatment in embodiments can be conducted in any of the know or after-developed methods. For example, it is known that post-halogenation, such as fluorination, can be conducted in several ways. One popular method is to expose the surface to be fluorinated to a fluorine plasma. The plasma can be created by several means including magnetic and electronic means. Electric fluorination is accomplished by exposing a fluorine containing gas to an oscillating electric field. This is called radio frequency (RF) plasma when operated at approximately 13.56 million cycles per second (MHz). A fluorine containing gas could be, but is not limited to, carbon tetrafluoromethane. This gas has a relatively high percentage of fluorine present. The gas is available, for example, under the tradename Freon R14 from E I Du Pont De Nemours & Co., Inc. Fluorination by RF plasma is well known in industry and in the art.

In embodiments, the process involves a two part fluorination process. The process involves a pre-clean step using Argon gas. The article to be fluorinated is first exposed to an Argon plasma. The Argon plasma has the effect of cleaning the surface of the article to be fluorinated. The article to be fluorinated is then exposed to the fluorine plasma without significant interruption of the process. This has the advantage of not allowing the article to become re-contaminated prior to the administration of the fluorine plasma.

The argon cleaning removes loosely bonded surface contamination that is not well adhered to the fluoropolymer. For example, argon plasma will remove ambient hydrocarbon, silicone residue contamination or any process residue that is only physisorbed on the surface. It does this by breaking bonds (few eV of energy required) and imparting enough kinetic energy (another few eV required) from the species in the plasma to cause ejection of fragments of contaminating material from the surface. Once clean, the fluorine plasma can break bonds in the surface and reform new chemical bonds with the base material of interest. In general, the plasma breaks bonds within 50-100 Angstroms of the surface and reacts after implantation into the surface. The radicals and reactive species that result from bond breaking then react with the fluorine plasma. CF and CF3 have asymmetric charge distributions that bond better with other species. The symmetric charge distribution in the CF2 moiety, particularly in a saturated system like PTFE (TEFLON®), renders it less likely to bond with other species.

One way to characterize the post-halogenated material is by means of a halogen/carbon ratio of the treated material. For example, a typical fluoropolymer material can have a fluorine/carbon ratio (number of fluorine atoms/number of carbon atoms) of 0.27 in it's native state (i.e. without rigorous surface cleaning), while polytetrafluoroethylene (PTFE, or TEFLON®) has a fluorine/carbon ratio of about 2. In embodiments, the post-halogenation treatment can raise the fluorine/carbon ratio. For example, the post-halogenation treatment of the typical fluoropolymer material can raise the fluorine/carbon ratio to above 2.0, such as about 2.17. In embodiments, it is preferred that a final fluorine/carbon ratio of the surface layer, after the post-halogenation, is at least about 1.0, more preferably at least about 1.2, and even more preferably at least about 1.5. It is believed that higher fluorine to carbon ratios are beneficial, where the higher fluorine to carbon ratios can be correlated to increased numbers of CF, CF2 and/or CF3 species.

Any suitable substrate can be selected for the fuser member. The fuser member substrate can be a roll, belt, flat surface, sheet, film, or other suitable shape used in the fixing of thermoplastic toner images to a suitable copy substrate. It can take the form of a fuser member, a pressure member, or a release agent donor member, preferably in the form of a cylindrical roll. Typically, the fuser member is made of a hollow cylindrical metal core, such as copper, aluminum, stainless steel, or certain plastic materials chosen to maintain rigidity and structural integrity, as well as being capable of having a polymeric material coated thereon and adhered firmly thereto. It is preferred that the supporting substrate is a cylindrical sleeve, preferably with an outer polymeric layer of from about 1 to about 6 millimeters. In one embodiment, the core, which can be an aluminum or steel cylinder, is degreased with a solvent and cleaned with an abrasive cleaner prior to being primed with a primer, such as Dow Corning® 1200, which can be sprayed, brushed, or dipped, followed by air drying under ambient conditions for thirty minutes and then baked at 150° C. for 30 minutes.

Also suitable are quartz and glass substrates. The use of quartz or glass cores in fuser members allows for a lightweight, low cost fuser system member to be produced. Moreover, the glass and quartz help allow for quick warm-up, and are therefore energy efficient. In addition, because the core of the fuser member comprises glass or quartz, there is a real possibility that such fuser members can be recycled. Moreover, these cores allow for high thermal efficiency by providing superior insulation.

When the fuser member is a belt, the substrate can be of any desired or suitable material, including plastics, such as Ultem®, available from General Electric, Ultrapek®, available from BASF, PPS (polyphenylene sulfide) sold under the tradenames Fortron®, available from Hoechst Celanese, Ryton R-4®, available from Phillips Petroleum, and Supec®, available from General Electric; PAI (polyamide imide), sold under the tradename Torlon® 7130, available from Amoco; polyketone (PK), sold under the tradename Kadel® E1230, available from Amoco; PI (polyimide); polyaramide; PEEK (polyether ether ketone), sold under the tradename PEEK 450GL30, available from Victrex; polyphthalamide sold under the tradename Amodel®, available from Amoco; PES (polyethersulfone); PEI (polyetherimide); PAEK (polyaryletherketone); PBA (polyparabanic acid); silicone resin; and fluorinated resin, such as PTFE (polytetrafluoroethylene); PFA (perfluoroalkoxy); FEP (fluorinated ethylene propylene); liquid crystalline resin (Xydar®), available from Amoco; and the like, as well as mixtures thereof. These plastics can be filled with glass or other minerals to enhance their mechanical strength without changing their thermal properties. In preferred embodiments, the plastic comprises a high temperature plastic with superior mechanical strength, such as polyphenylene sulfide, polyamide imide, polyimide, polyketone, polyphthalarnide, polyether ether ketone, polyethersulfone, and polyetherimide. Suitable materials also include silicone rubbers. Examples of belt-configuration fuser members are disclosed in, for example, U.S. Pat. Nos. 5,487,707 and 5,514,436, the disclosures of each of which are totally incorporated herein by reference. A method for manufacturing reinforced seamless belts is disclosed in, for example, U.S. Pat. No. 5,409,557, the disclosure of which is totally incorporated herein by reference.

The optional intermediate layer can be of any suitable or desired material. For example, the optional intermediate layer can comprise a silicone rubber of a thickness sufficient to form a conformable layer. Suitable silicone rubbers include room temperature vulcanization (RTV) silicone rubbers, high temperature vulcanization (HTV) silicone rubbers, and low temperature vulcanization (LTV) silicone rubbers. These rubbers are known and are readily available commercially such as SILASTIC® 735 black RTV and SILASTIC® 732 RTV, both available from Dow Coming, and 106 RTV Silicone Rubber and 90 RTV Silicone Rubber, both available from General Electric. Other suitable silicone materials include the silanes, siloxanes (preferably polydimethylsiloxanes), such as fluorosilicones, dimethylsilicones, liquid silicone rubbers, such as vinyl crosslinked heat curable rubbers or silanol room temperature crosslinked materials, and the like. Other materials suitable for the intermediate layer include polyimides and fluoroelastomers, including those set forth below.

The optional intermediate layer typically has a thickness of from about 0.05 to about 10 millimeters, preferably from about 0.1 to about 5 millimeters, and more preferably from about 1 to about 3 millimeters, although the thickness can be outside of these ranges. More specifically, if the intermediate layer is present on a pressure member, it typically has a thickness of from about 0.05 to about 5 millimeters, preferably from about 0.1 to about 3 millimeters, and more preferably from about 0.5 to about 1 millimeter, although the thickness can be outside of these ranges. When present on a fuser member, the intermediate layer typically has a thickness of from about 1 to about 10 millimeters, preferably from about 2 to about 5 millimeters, and more preferably from about 2.5 to about 3 millimeters, although the thickness can be outside of these ranges. In a preferred embodiment, the thickness of the intermediate layer of the fuser member is higher than that of the pressure member, so that the fuser member is more deformable than the pressure member.

The polymer layers of the fuser member can be coated on the fuser member substrate by any desired or suitable means, including normal spraying, dipping, and tumble spraying techniques. A flow coating apparatus as described in U.S. Pat. No. 6,408,753, the disclosure of which is totally incorporated herein by reference, can also be used to flow coat a series of fuser rolls. It is preferred that the polymers be diluted with a solvent, and particularly an environmentally friendly solvent, prior to application to the fuser substrate. Alternative methods, however, can be used for coating layers, including methods described in U.S. Pat. No. 6,099,673, the disclosure of which is totally incorporated herein by reference.

Optional intermediate adhesive layers and/or intermediate polymer or elastomer layers may be applied to achieve desired properties and performance objectives of the present disclosure. The intermediate layer may be present between the substrate and the outer fluoroelastomer surface. An adhesive intermediate layer may be selected from, for example, epoxy resins and polysiloxanes. Examples of suitable intermediate layers include silicone rubbers such as room temperature vulcanization (RTV) silicone rubbers; high temperature vulcanization (HTV) silicone rubbers and low temperature vulcanization (LTV) silicone rubbers. These rubbers are known and readily is available commercially such as SILASTIC® 735 black RTV and SILASTIC® 732 RTV, both from Dow Coming; and 106 RTV Silicone Rubber and 90 RTV Silicone Rubber, both from General Electric. Other suitable silicone materials include the siloxanes (such as polydimethylsiloxanes); fluorosilicones such as Silicone Rubber 552, available from Sampson Coatings, Richmond, Va.; liquid silicone rubbers such as vinyl crosslinked heat curable rubbers or silanol room temperature crosslinked materials; and the like. Another specific example is Dow Coming Sylgard 182.

There may be provided an adhesive layer between the substrate and the intermediate layer. There may also be an adhesive layer between the intermediate layer and the outer layer. In the absence of an intermediate layer, the fluoroelastomer layer may be bonded to the substrate via an adhesive layer.

The thickness of the intermediate layer is from about 0.5 to about 20 mm, or from about 1 to about 5 mm.

An example is set forth hereinbelow and is illustrative of different compositions and conditions that can be utilized in practicing the disclosure. All proportions are by weight unless otherwise indicated. It will be apparent, however, that the disclosure can be practiced with many types of compositions and can have many different uses in accordance with the disclosure above and as pointed out hereinafter.

EXAMPLES

Example 1

A post-halogenated fuser member is prepared as follows.

A conventional fuser member is obtained, which contains as an outer surface layer, a layer of VITON®. The conventional fuser member does not contain a layer of a release agent applied to the surface layer.

The fuser member is washed with isopropyl alcohol to remove contaminants and impurities. The washed fuser member is placed in a plasma treatment apparatus, which is pumped down to 0.2 atm., and held for 10 minutes to allow to some degree outgassing of the fuser member. Argon flow is started to the plasma chamber, raising the pressure to 0.5 atm. and allowed to stabilize for 2 minutes. Next, Rf power is turned on, at 100 Watts and a frequency of 13.56 MHz. The chamber is maintained in this condition for 5 minutes, and then the Rf power is turned off. The treatment with argon gas is a cleaning step, because the argon atoms bombard the fuser member surface, but do not bond to the fuser member. Instead, the argon gas simply dislodges surface atoms to clean the surface.

The plasma chamber is again pumped down to 0.2 atm., and held for 2 minutes to clear any residual Argon. Tetrafluoromethane flow is started to the plasma chamber, raising the pressure to 0.5 atm. and allowed to stabilize for 2 minutes. Next, Rf power is turned on, at 100 Watts and a frequency of 13.56 MHz. The chamber is maintained in this condition for 10 minutes, and then the Rf power is turned off. The chamber is then purged with nitrogen gas for 2 minutes. The treatment with tetrafluoromethane gas, like argon gas, bombards the fuser member surface. However, the tetrafluoromethane gas bonds to the fuser member surface, to provide the post-fluorinated material. The treatment generally attacks $CH_2$—$CH_2$ moieties, and either replaces a hydrogen atom with a fluorine atom, or breaks the C—C bond and fluorinates the resulting radicals.

The results is a fuser member, which can be used with a toner composition to develop electrostatographic images.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A method of making a fuser member, comprising:

applying an outer layer comprising a polymeric material over a substrate;

subjecting said polymeric material of said outer layer to a halogen containing gas; and exposing the halogen containing gas to an oscillating electric field to provide a post-halogenated polymeric material.

2. The method according to claim 1, wherein said method does not comprise applying a release oil to the outer layer.

3. The method according to claim 1, further comprising cleaning said outer layer prior to subjecting said polymeric material of said outer layer to the halogen containing gas.

4. The method according to claim 3, wherein said cleaning comprising exposing said outer surface to an argon plasma.

5. The method according to claim 1, wherein said polymeric material is post-fluorinated.

6. The method according to claim 1, wherein said post-halogenated outer layer has a fluorine/carbon ratio that is higher than a fluorine/carbon ratio of said polymeric material before post-halogenation.

7. An image forming apparatus for forming images on a recording medium comprising:

a charge-retentive surface to receive an electrostatic latent image thereon;

a development component to apply a developer material to the charge-retentive surface to develop the electrostatic latent image to form a developed image on the charge retentive surface;

a transfer component to transfer the developed image from the charge retentive surface to a copy substrate; and a fuser member component to fuse the transferred developed image to the copy substrate, wherein the fuser member comprises:

a substrate; and an outer layer comprising a polymeric material;

wherein said polymeric material is subjected to a halogen containing gas that is exposed to an oscillating electric field, wherein the polymeric material is post-halogenated to provide a post-halogenated polymeric material by the halogen containing gas.

8. The image forming apparatus of claim 7, wherein said fuser member does not include a release oil applied to the outer layer.

9. A method of making a fuser member, comprising:

applying an outer layer comprising a polymeric material over a substrate; and exposing the outer layer to a halogen source, wherein the halogen source is a plasma and wherein the polymeric material of the outer layer is post-halogenated by the halogen source to provide a post-halogenated polymeric material.

10. The method according to claim 9, wherein said polymeric material is a fluoroelastomer selected from the group consisting of a) copolymers of two of vinylidene fluoride, hexafluoropropylene and tetrafluoroethylene; b) terpolymers of vinylidene fluoride, hexafluoropropylene and tetrafluoroethylene; and c) tetrapolymers of vinylidene fluoride, hexafluoropropylene, tetrafluoroethylene, and a cure site monomer.

11. The method according to claim 10, wherein the fluoroelastomer is a tetrapolymer of vinylidene fluoride, hexafluoropropylene, tetrafluoroethylene, and a cure site monomer.

12. The method according to claim 10, wherein the fluoroelastomer comprises about 35 weight percent of vinylidenefluoride, about 34 weight percent of hexafluoropropylene, about 29 weight percent of tetrafluoroethylene, and about 2 weight percent cure site monomer.

13. The method according to claim 10, wherein said outer layer comprises in addition to said fluoroelastomer, a fluoropolymer selected from the group consisting of polytetrafluoroethylene and perfluoroalkoxy.

14. The method according to claim 13, wherein said fluoropolymer is polytetrafluoroethylene.

15. The method according to claim 9, wherein said polymeric material is post-fluorinated.

16. The method according to claim 9, wherein said post-halogenated polymeric material has a fluorine/carbon ratio that is higher than a fluorine/carbon ratio of said polymeric material before post-halogenation.

17. The method according to claim 9, wherein said polymeric material is non-halogenated.

18. The method according to claim 9, further comprising an intermediate layer positioned between the substrate and the outer layer.

19. The method according to claim 18, wherein the intermediate layer comprises silicone rubber.

20. The method according to claim 9, wherein the substrate is in the form of a belt or a roller.

* * * * *